US005255883A

United States Patent [19]

Greenfield et al.

[11] Patent Number: 5,255,883

[45] Date of Patent: Oct. 26, 1993

[54] BAG PACK AND HOLDER THEREOF

[75] Inventors: Michael L. Greenfield, Newington; Lawrence Greenfield, West Hartford, both of Conn.

[73] Assignee: Connecticut Packaging Materials, Inc., New Britain, Conn.

[21] Appl. No.: 902,959

[22] Filed: Jun. 23, 1992

[51] Int. Cl.[5] ..... B65B 67/12

[52] U.S. Cl. ..... 248/95; 206/493; 220/407

[58] Field of Search ..... 248/95, 99, 101, 316.7, 248/313; 141/314, 391; 211/12, 71; 220/407; 206/493, 554; 383/37

[56] References Cited

U.S. PATENT DOCUMENTS 3,145,839 8/1964 Lowry ..... 211/12 X
3,679,127 7/1972 Stefacin ..... 383/37
4,932,560 6/1990 Roen ..... 248/95 X
5,088,667 2/1992 Olson ..... 248/95 X
5,119,968 6/1992 Palmer ..... 221/26

*Primary Examiner*—Ramon O. Ramirez
*Attorney, Agent, or Firm*—McCormick, Paulding & Huber

[57] ABSTRACT

A bag pack and a holder comprises a layered stack of flexible thermo-plastic bags having a folded over stiff header with oppositely projecting ears at its ends. The ears enter beneath flaps at opposite ends of a holder when bent rearwardly and inwardly. A central flap on the holder retains the header against forward pivotal movement as might dislodge the ears and the individual bags have exposed top openings when so arranged for successive removal from the pack. A second embodiment includes flaps on a holder entered between front and rear portions of a header for retention of the bag pack.

36 Claims, 4 Drawing Sheets

BAG PACK AND HOLDER THEREOF

BACKGROUND OF THE INVENTION

The present invention relates to a bag pack and a holder for supporting the bag pack for the successive removal of individual bags therefrom. The bag pack comprises a layered stack of flexible thermo-plastic bags and a header of relatively stiff material which is folded about the upper portions of the bag pack and which has oppositely projecting ears for attachment with a holder. The holder is adapted to be mounted adjacent a corner between intersecting horizontal and vertical surfaces such that the header of the bag pack is retained thereby with the bag depending along the vertical surface or, alternatively, extending along the horizontal surface away from the holder.

Bag packs and holders generally similar to the foregoing have been available but have not been wholly satisfactory. A high degree of simplicity in construction and arrangement of the holder as well as the bag pack is essential together with a high degree of ease and convenience in the successive removal of the bags from the pack with the latter retained by the holder.

It is the general object of the present invention to provide an improved bag pack and holder system wherein the bag pack is of a desirably simple construction, capable of manufacture at economic advantage, and yet cooperates with a holder also of relatively simple construction to provide a high degree of ease and convenience in the mounting of bag packs on the holder and in the subsequent removal of individual bags from the pack.

SUMMARY OF THE INVENTION

The foregoing general object is fulfilled in the provision of a bag pack and a holder wherein the bag pack includes a layered stack of flexible thermo-plastic bags each having flat generally co-extensive front and rear panels integrally connected along transverse bottom and opposite longitudinal side edges. A header of relatively stiff material has opposing narrow transversely extending front and rear portions respectively overlying narrow transversely extending upper edge portions of front and rear bags in the pack. The opposing header portions are interconnected to capture and secure the upper edge portions of the bags and the pack therebetween and at least one of the front and rear header portions has a pair of transversely outwardly projecting narrow flat ears at opposite ends thereof. Each of the bags also has a transversely extending tear line in at least one of its front and rear panels, preferably the rear panel with the front panel terminating at its upper edge beneath the upper edge of the rear panel. Thus, an exposed readily accessible opening between the front and rear panels of each bag is provided for the introduction of various items as, for example, in a fast food outlet.

A holder for the bag pack includes an elongated transversely extending body member which is adapted to be mounted adjacent and along a corner between substantially horizontal and vertical surfaces so as to releasably secure a header of a bag pack with the bags of the pack extending therefrom along one of the surfaces. Alternatively, the bag pack may depend from the holder so as to extend along the vertical surface or the pack may extend along the horizontal surface away from the holder and away from the corner between the horizontal and vertical surfaces. The holder includes means at opposite ends thereof for respectively receiving the aforementioned header ears in inwardly folded positions and for retaining the same whereby to secure the header and the bag pack during the successive manual tearing of individual bags therefrom.

Preferably, the interconnection between the front and rear portions of the header is provided by spaced stapling with the header comprising a folded-over cardboard member or the like resulting in the integral connection of the front and rear portions with the ears disposed at opposite ends of the rear portion thereof. Alternatively, the header may be of molded plastic or other appropriate construction. Further, and in accordance with the presently preferred practice, the upper edge at the front panel of each bag terminates short of the lower edge of the front portion of the header with the tear line in the rear panel at least approximately coincident and co-extensive therewith. Thus, the opening for the introduction of items to each bag is readily accessible with the bag pack secured to the holder so as to expose the front panels and the openings seriatim during successive bag removal. In use of the bag pack and holder, an item to be bagged, as in a fast food outlet, may be inserted into the front opening in a bag prior to the tearing of the bag from the bag pack, more or less simultaneously with tearing, or, the bag may be initially removed from the pack and the item subsequently introduced through its opening.

The holder may vary widely in form but preferably comprises a generally flat plate having means at opposite ends at least partially defining outwardly opening slots for receiving and retaining the inwardly bent ears at the opposite ends of the header. More specifically, opposing flaps are provided at each end of the holder and are spaced forwardly from the holder and also from each other for the ease of entry of the ears therebehind. Further, an additional flap, which may be located at an intermediate zone along the length of the holder is adapted to extend forwardly and downwardly about the header so as to prevent the same from pivoting forwardly at its upper edge during removal of bags from the pack. The combination of the slots and the additional flap positively retain the header in position relative to the holder and thus secure the bag pack in position relative to the holder.

In a further embodiment of the invention, the header of the bag pack is devoid of oppositely projecting ears but is provided with transversely spaced interconnecting means accommodating retention areas therebetween. Flaps spaced along a holder to enter such retention areas are inserted between the front and rear portions of the header and restrain the header against downward or forward movement when the bags in the bag pack are successively removed therefrom.

DESCRIPTION OF THE PREFERRED EMBODIMENTS

Figure 3:
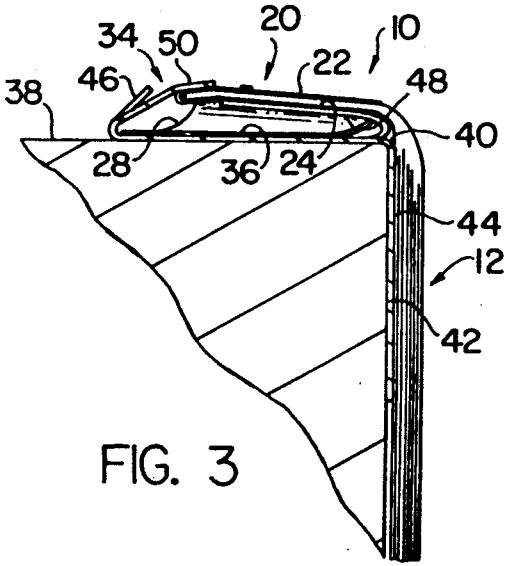
FIG. 3 is a sectional view taken generally as indicated at 3,3 in FIG. 2 and further illustrating the connection of the header of the bag pack with the holder as well as the construction of the bag pack.
Figure 4:
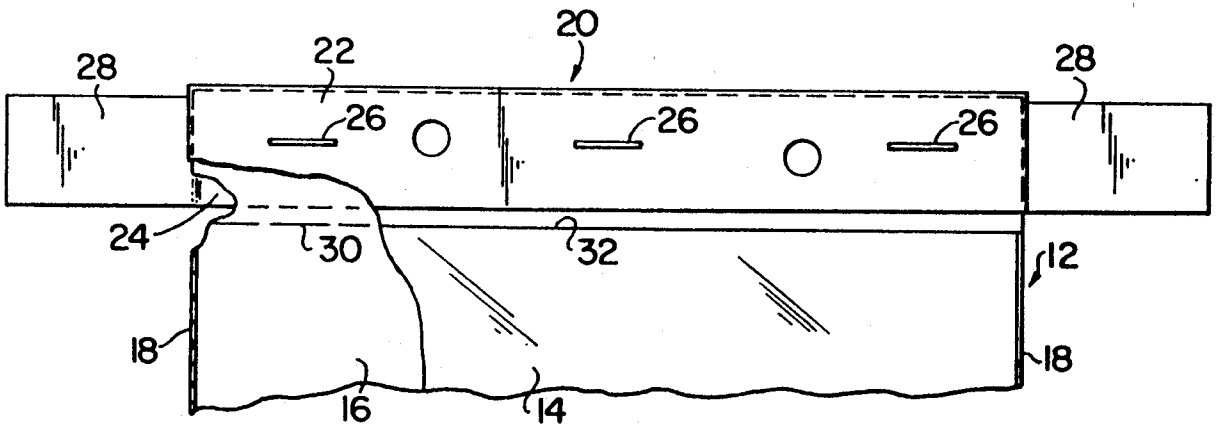
FIG. 4 is a fragmentary view showing a bag pack with its header ears extending prior to assembly with a holder.

Referring particularly to FIGS. 1–4, it will be observed that a bag pack indicated generally at 10 comprises a layered stack of flexible thermo-plastic bags 12,12 each having flat generally co-extensive front and panels 14,16, FIG. 4 The front and rear panels 14,16 of each bag 12 are integrally connected along a transverse bottom edge, not shown, and along opposite longitudinal side edges 18,18. A header, indicated generally at 20 is of a relatively stiff material and has opposing narrow transversely extending front and rear portions 22,24 respectively overlying narrow transversely extending upper edge portions of the front and rear bags in a pack of bags. The opposing front and rear header portions 22,24 are interconnected, preferably by spaced apart stapling at 26,26 whereby to capture and to secure the said upper edge portions of the bags in the pack therebetween. At least one of the front and rear header portions 22,24, preferably the rear portion 24 as shown, has a pair of transversely outwardly projecting narrow flat ears 28,28 at opposite ends thereof. Further, each of the bags 12,12 has a transversely extending tear line in at least one of its front and rear panels, preferably the rear panel 16 as shown at 30. The tear line 30 is arranged in spaced relationship with the transverse upper edge of the bags and, preferably and as shown, the tear line 30 is disposed beneath the lower edge of the header 20. The front panel 14 is also preferably foreshortened at its upper end so as to terminate along a transversely extending line 32 which may be at least approximately coincident with the tear line 30 in each bag back panel as illustrated in FIG. 4.

Figure 1:
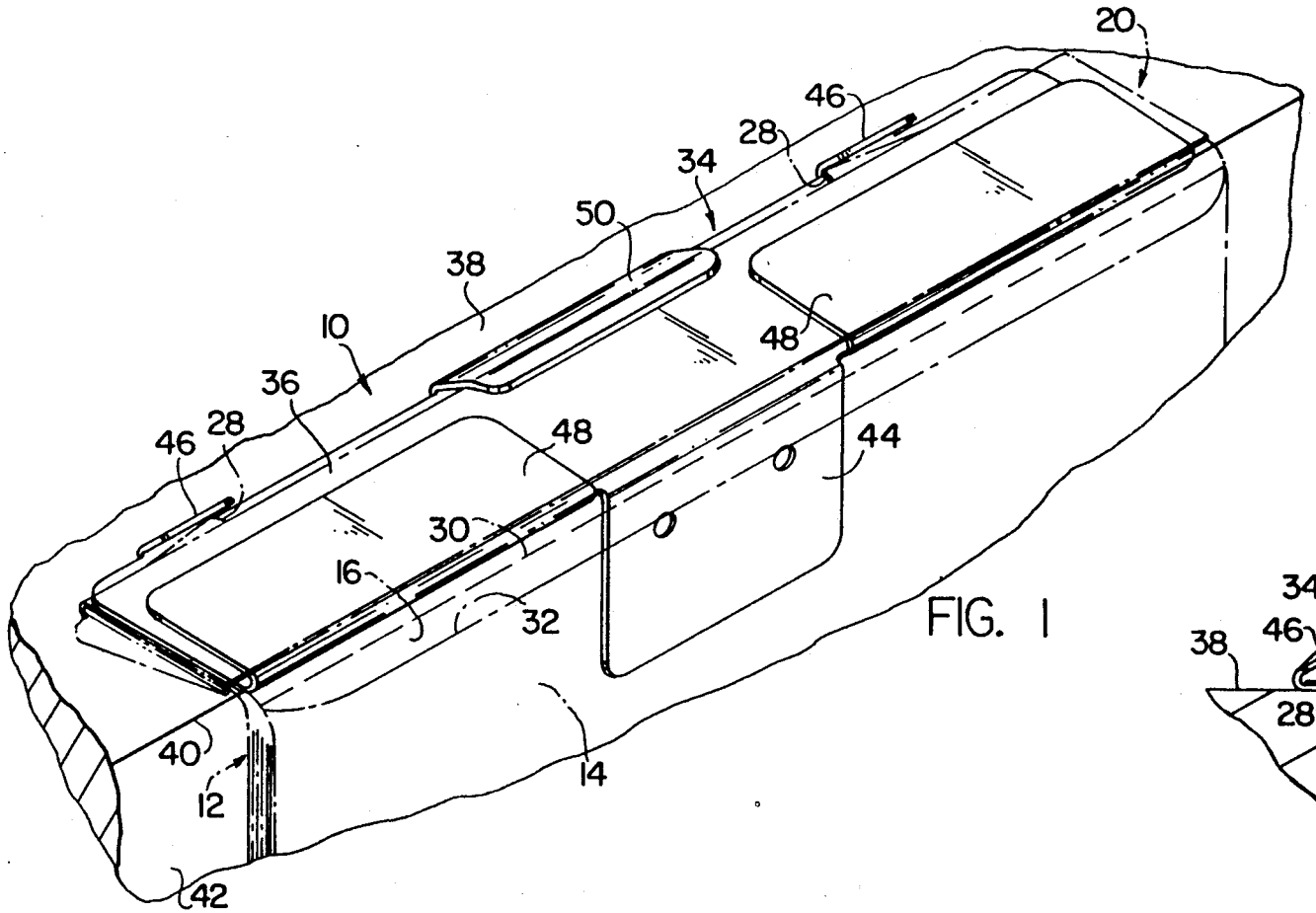
FIG. 1 of the drawing is a perspective view illustrating a bag pack and its associated holder in operative position adjacent a corner of intersecting horizontal and vertical surfaces.

Reverting now to FIG. 1, and observing that a front panel 14 of a forwardmost bag in the pack 10 has an opening at 32 and a tear line 30 therebehind, it will be apparent that the introduction of an item to be bagged between the front and rear panels 14,16 of the forwardmost bag can be readily accomplished. Alternatively, the forwardmost panel 14 can be pulled forwardly in FIG. 1 at its upper edge 32, or the bag can be first removed from the pack in a tearing action along the line 30 with the item thereafter introduced between the front and rear panels 14,16.

Figure 2:
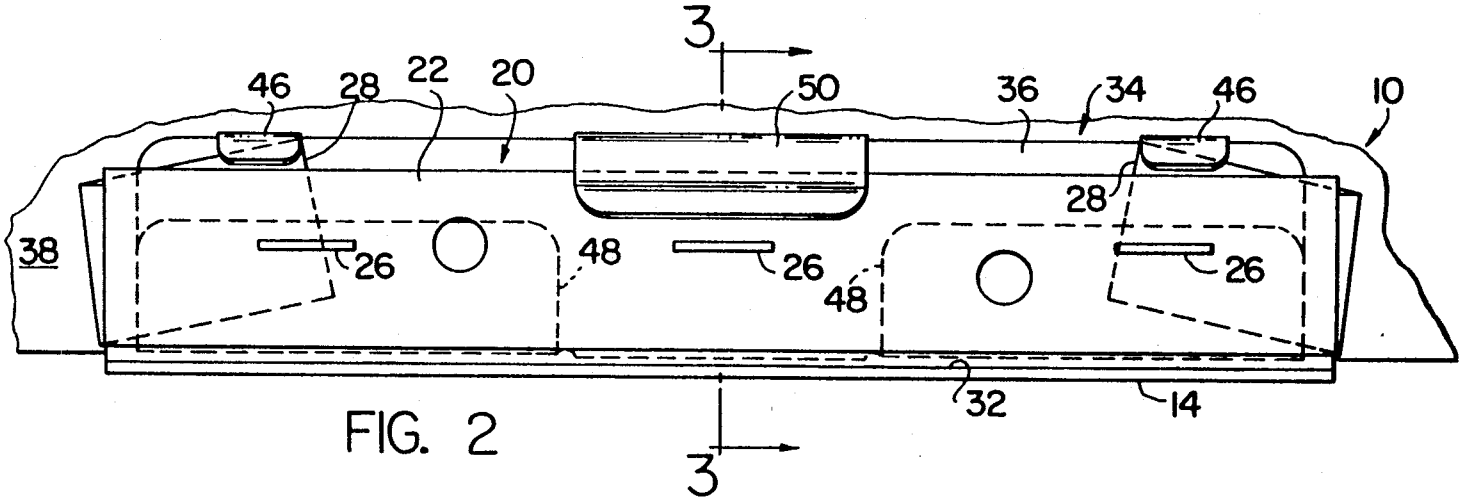
FIG. 2 is a top view of the bag pack and holder of FIG. 1 illustrating the manner in which the ears on the header of the bag pack are retained by the holder.

A holder for the bag pack indicated generally at 34 in FIGS. 1, 2, and 3 comprises an elongated transversely extending body member 36 which is preferably flat and which is adapted to be mounted adjacent and along a corner between intersecting substantially horizontal and vertical surfaces. As best illustrated in FIGS. 1 and 3, the holder 34 is preferably mounted atop a horizontal surface 38 adjacent a corner 40 between the horizontal surface 38 and an intersecting vertical surface 42. The holder 34 may be secured in position, for example by adhesive means or by screws associated with an integrally formed flat right-angularly related portion thereof at 44. At opposite ends of the holder 34 means are provided for respectively receiving the header ears 28,28 in inwardly folded positions of the latter and for retaining the same and thus securing the header 20 and the bag pack 10 during the successive manual tearing of individual bags from the pack. More particularly, the holder 34 includes first and second oppositely directed flaps 46,48 at each end thereof which at least partially define transversely outwardly open slots for receiving the ears 28,28. As illustrated, the flaps 46,48 are integrally formed with the flat body member 36 of the holder 34 and are spaced forwardly from the body member and also spaced from each other across the member for ease of insertion of the bent ears into the slot between the flaps and the body member. The length of the flaps 46,48 along the body member 36 may vary but it is presently preferred that relatively short flaps 46,46 be provided with the flaps 48,48 substantially longer.

Preferably and as illustrated in FIGS. 1 and 2, an additional flap is provided at 50 intermediate the length of the holder 34 and along an upper edge thereof. The flap 50 is spaced from the flat body member 36 and extends forwardly and downwardly so as to restrain a central portion of the header 20 against pivotal forward and downward movement such as might dislodge the ears 28,28 from the flaps 46,48. As will be apparent, particularly in FIG. 2, the ears 28,28 when bent rearwardly and inserted within the slots partially defined by the flaps 46,48 may tend to pivot in their own planes when force is exerted in the plane tearing a bag from the bag pack 10. Thus, the flaps 46,46 tend to retain the ears against excessive pivoting movement and thus retain the header in position in the desired assembled position relative to the holder 34. There may also be a tendency for the header and the ears 28,28 to move forwardly out of the plane of the drawing in FIG. 2 and this force is of course reacted by both flaps 46,48 and the flap 50. In FIGS. 1, 2, and 3 the rear portion 24 of a header 20 is disposed in overlying relationship with the flaps 48,48 with the ears 28,28 bent rearwardly and inwardly therefrom and entered behind the flaps 48,48 as well as behind the flaps 46,46.

Figure 5:
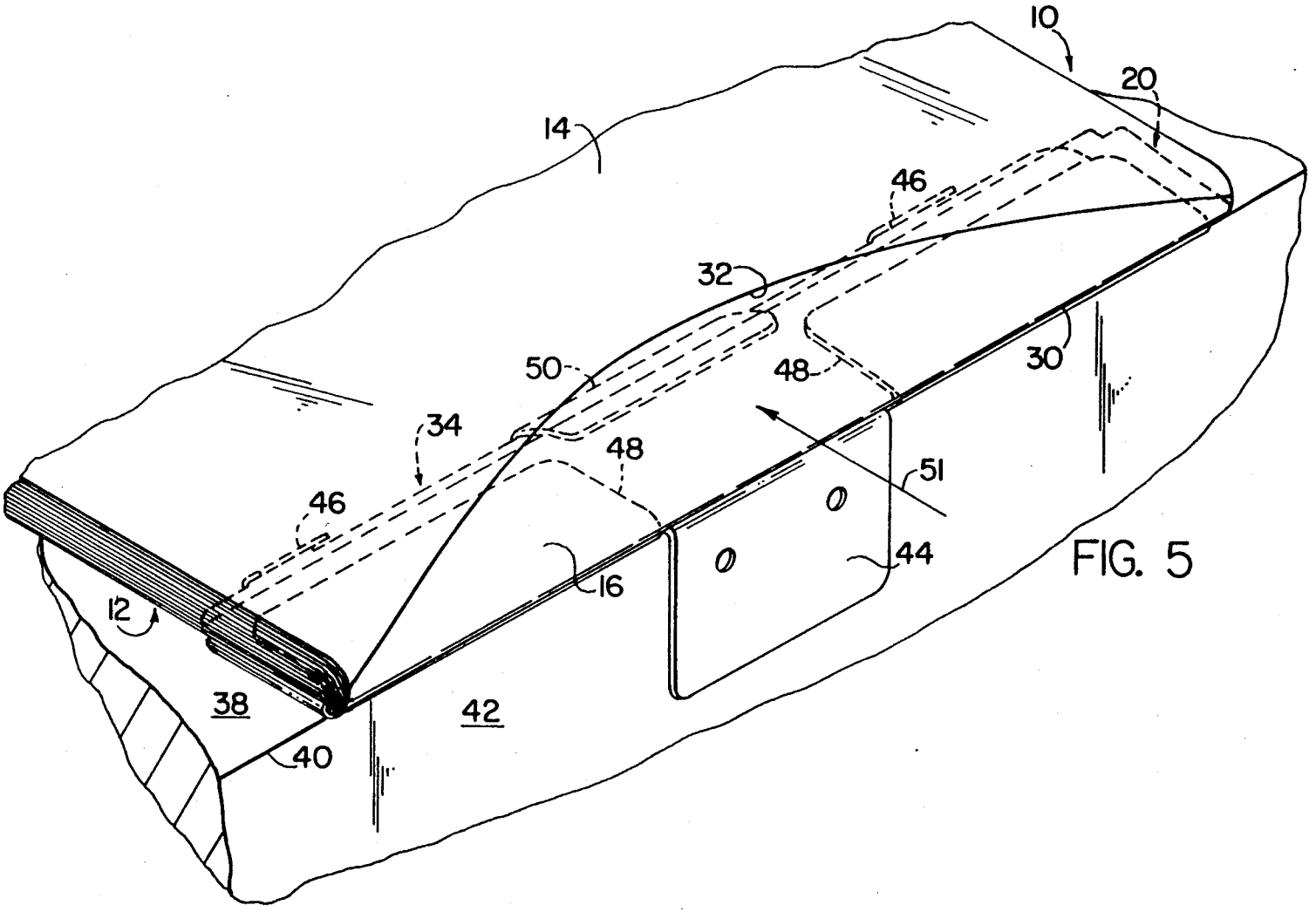
FIG. 5 a further perspective view similar to FIG. 1 but showing a pack and holder with the bag pack extending away from the holder along a horizontal surface.

In FIG. 5, the bag pack 10 is rotated through 180° so as to arrange the front portion 22 of the header 20 in overlying relationship with the flap 48,48 while the ears 28,28 are once again folded rearwardly and inwardly to enter the slots behind the flaps 46,48. The bag pack, which normally depends along the adjacent vertical surface 42, can be lifted upwardly and rearwardly through 270° so as to extend along the horizontal surface 38 and to position the front panels 14 of the bags upwardly in the bag pack 10. As will be apparent, the upper edge 32 of each front panel is thus disposed atop the bag pack as the front panels are successively exposed so as to be lifted to curva-linear attitude as illustrated in FIG. 5. The entry of an item of food etc. in a fast food outlet is thus accommodated horizontally along the line of the arrow 51 prior to or during bag tear-off.

Figure 6:
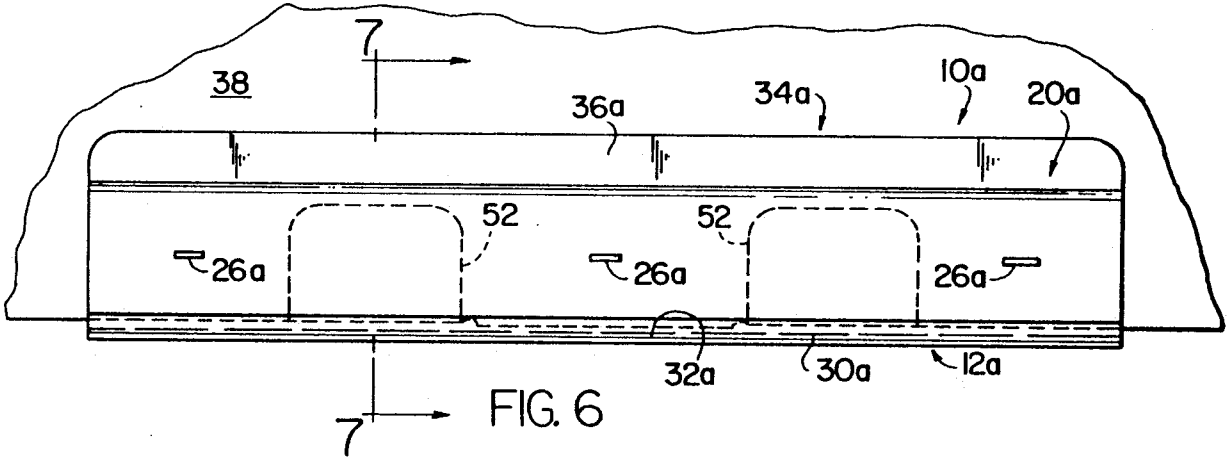
FIG. 6 a top view of a bag pack and holder similar to FIG. 2 but illustrating a further embodiment of the present invention.
Figure 7:
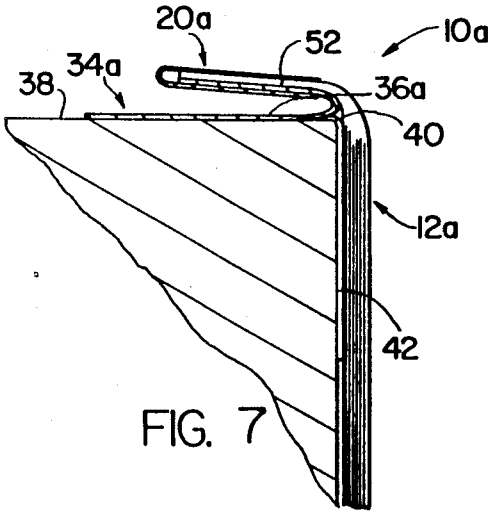
FIG. 7 a sectional view taken generally as indicated at 7,7 in FIG. 6.

In FIGS. 6 and 7 an alternative embodiment of the present invention is illustrated wherein a bag pack **10*a* has an associated header 20*a* and a co-operating holder indicated generally at 34*a*. The bag pack 10*a* may be identical with that described above but the header 20*a* is devoid of ears 28,28 and instead is provided with regions between staples 26*a*,26*a* for the entry of retaining flaps 52,52. The flaps 52,52 are formed on the body portion 36***a* of the holder 34*a* and extend in spaced relationship therewith so as to enter between the front and rear portions of the header 20*a* between the staples 26*a*,26*a* as illustrated. While this arrangement does not provide for an equally positive retention of the bag pack, as compared with the arrangement of FIGS. 1-5, the bag pack may nevertheless be satisfactorily secured in environments wherein, for example, the tearing forces during individual bag removal may be somewhat less strenuous.

From the foregoing it will be apparent that the bag pack and holder of the present invention are of desirably simple construction capable of manufacture and distribution at economic advantage, and yet provide for the convenient assembly of bag packs and holder, for example, along the edges of counters and tables in fast food outlets, and thereafter provide for a high degree of ease and convenience in use.

I claim:

1. The combination of a bag pack and a holder for supporting the bag pack for the successive removal of individual bags therefrom; said combination comprising a bag pack including a layered stack of flexible thermoplastic bags each having flat generally co-extensive front and rear panels integrally connected along transverse bottom and opposite longitudinal side edges, a header of relatively stiff material having opposing narrow transversely extending front and rear portions respectively overlying narrow transversely extending upper edge portions of front and rear bags in the pack, said opposing header portions being interconnected to capture and secure said upper edge portions of the bags in the pack therebetween, at least one of said front and rear header portions having a pair of transversely outwardly projecting narrow flat ears at opposite ends thereof, and each of the bags having a transversely extending tear line in at least one of its front and rear panels in spaced relationship with its transverse upper edge, and a holder including an elongated transversely extending body member adapted to be mounted adjacent and along a corner between intersecting substantially horizontal and vertical surfaces so as to releasably secure a header of a bag pack with the bags in the pack extending longitudinally therefrom along one of said surfaces, said holder including means at opposite ends thereof for respectively receiving said header ears in inwardly folded positions and for retaining the same and thus securing the header and the bag pack during the successive manual tearing of individual bags therefrom.

2. The combination of a bag pack and a holder as set forth in claim 1 wherein the front and rear header portions are interconnected by means extending through the upper portion of the bag pack, and wherein the tear lines in the bags are arranged beneath said interconnection means and on a side thereof opposite the upper edges of the bags.

3. The combination of a bag pack and a holder as set forth in claim 1 wherein each bag front panel terminates short of the upper edge of its associated rear panel to provide a readily accessible opening between panels, and wherein each bag rear panel includes the aforementioned tear line at a location at least approximately coincident with the upper edge of its associated front panel.

4. The combination of a bag pack and a holder as set forth in claim 3 wherein both the rear panel tear lines and the upper edges of front bag panels are disposed beneath the interconnection between the front and rear portions of the header.

5. The combination of a bag pack and a holder as set forth in claim 1 wherein said header front and rear portions are integrally connected along upper edges thereof, and wherein said interconnection therebetween takes the form of stapling through said front and rear portions and through the upper portions of bags captured therebetween.

6. The combination of a bag pack and a holder as set forth in claim 5 wherein said transversely projecting ears are formed integrally at opposite ends of said rear portion of said holder and are bent rearwardly and inwardly.

7. The combination of a bag pack and a holder as set forth in claim 1 wherein said holder body member is generally flat and adapted to be mounted on the horizontal surface adjacent and along the corner between the aforesaid horizontal and vertical surfaces, the bags secured by the holder extending around the corner and depending adjacent the vertical surface.

8. The combination of a bag pack and a holder as set forth in claim 7 wherein the front panel of each bag terminates short of the lower edge of the front portion of the header to provide a readily accessible opening between bag panels, and wherein the bag pack is secured to the holder so as to expose said front panels and openings seriatim during successive bag removal.

9. The combination of a bag pack and a holder as set forth in claim 1 wherein said holder body member is generally flat and adapted to be mounted on the horizontal surface adjacent and along the corner between the horizontal and vertical surfaces, the bags secured by the holder extending therefrom atop the horizontal surface and in a direction away from the corner between the horizontal and vertical surfaces.

10. The combination of a bag pack and a holder as set forth in claim 9 wherein the front panel of each bag terminates short of the lower edge of the front portion of the header to provide a readily accessible opening between bag panels, and wherein the bag pack is secured to the holder to expose said front panels and openings seriatim during successive bag removal.

11. The combination of a bag pack and a holder as set forth in claim 1 wherein said means at opposite ends of said holder at least partially define transversely outwardly opening slots for respectively receiving said inwardly folded ears and for substantially securing the same against both forward displacement and pivotal deformation in the plane of the ears during removal of a bag from the pack.

12. The combination of a bag pack and a holder as set forth in claim 11 wherein each of said slots is formed by oppositely and inwardly projecting generally U-shaped flaps formed integrally with the body of the holder and spaced from the body member and from each other at free end portions thereof.

13. The combination of a bag pack and a holder as set forth in claim 12 wherein an additional flap is provided and extends at least about and forwardly of an intermediate portion of the header to restrain the latter against forward and downward pivotal movement tending to dislodge the ears from their respective slots.

14. A bag pack for use with a holder for supporting the bag pack by engagement with a pair of flat transversely spaced apart inwardly folded ears, the bag pack thus supported being adapted for the successive removal of individual bags therefrom; said bag pack including a layered stack of flexible thermoplastic bags each having flat generally co-extensive front and rear panels integrally connected along transverse bottom and opposite longitudinal side edges, a header of relatively stiff material having opposing narrow transversely extending front and rear portions respectively overlying narrow transversely extending upper edge portions of front and rear bags in the pack, said opposing header portions being interconnected to capture and secure said upper edge portions of the bags in the pack therebetween, at least one of said front and rear header portions having a pair of transversely projecting bendable narrow flat ears at opposite ends thereof for cooperation with the holder, and each of the bags having a transversely extending tear line in at least one of its front and rear panels in spaced relationship with its transverse upper edge.

15. A bag pack as set forth in claim 14 wherein the front and rear header portions are interconnected by means extending through the upper portion of the bag pack, and wherein the tear lines in the bags are arranged beneath said interconnection means and on a side thereof opposite the upper edges of the bags.

16. A bag pack as set forth in claim 14 wherein each bag front panel terminates short of the upper edge of its associated rear panel to provide a readily accessible opening between panels, and wherein each bag rear panel includes the aforementioned tear line at a location at least approximately coincident with the upper edge of its associated front panel.

17. A bag pack as set forth in claim 16 wherein both the rear panel tear lines and the upper edges of front bag panels are disposed beneath the interconnection between the front and rear portions of the header.

18. A bag pack as set forth in claim 14 wherein said header front and rear portions are integrally connected along upper edges thereof, and wherein said interconnection therebetween takes the form of stapling through said front and rear portions and through the upper portions of bags captured therebetween.

19. A bag pack as set forth in claim 18 wherein said transversely projecting ears are formed integrally at opposite ends of said rear portion of said holder and are bent rearwardly and inwardly.

20. A bag pack as set forth in claim 14 wherein the front panel of each bag terminates short of the lower edge of the front portion of the header to provide a readily accessible opening between bag panels, and wherein the bag pack is secured to its holder so as to expose said front panels and openings seriatim during successive bag removal.

21. A holder for supporting a bag pack for the successive removal of individual bags therefrom; said bag pack including a layered stack of flexible thermoplastic bags each having flat generally co-extensive front and rear panels integrally connected along transverse bottom and opposite longitudinal side edges, a header of relatively stiff material having opposing narrow transversely extending front and rear portions respectively overlying narrow transversely extending upper edge portions of front and rear bags in the pack, said opposing header portions being interconnected to secure said upper edge portions of the bags in the pack therebetween, at least one of said front and rear header portions having a pair of transversely projecting narrow flat ears at opposite ends thereof, and each of the bags having a transversely extending tear line in at least one of its front and rear panels in spaced relationship with its transverse upper edge; and said holder comprising an elongated transversely extending body member adapted to be mounted adjacent and along a corner between substantially horizontal and vertical surfaces so as to releasably secure a header of a bag pack with the bags in the pack extending therefrom along one of said surfaces, said holder including means at opposite ends thereof for respectively receiving said header ears in inwardly folded positions and for retaining the same and thus securing the header and the bag pack during the successive manual tearing of individual bags therefrom.

22. A holder for a bag pack as set forth in claim 21 wherein said holder body member is generally flat and adapted to be mounted on the horizontal surface adjacent and along the corner between the horizontal and vertical surfaces, the bags secured by the holder extending therefrom around the corner and depending adjacent the vertical surface.

23. A holder for a bag pack as set forth in claim 21 wherein the front panel of each bag terminates short of the lower edge of the front portion of the header to provide a readily accessible opening between bag panels, and wherein the bag pack is secured to the holder to expose said front panels and openings seriatim during successive bag removal.

24. A holder for a bag pack as set forth in claim 21 wherein said means at opposite ends of said holder at least partially define transversely outwardly opening slots for respectively receiving said inwardly folded header ears and for substantially securing the same against both forward displacement and pivotal deformation in the plane of the ears during removal of a bag from the pack.

25. A holder for a bag pack as set forth in claim 24 wherein each of said slots is formed by oppositely and inwardly projecting generally U-shaped flaps formed integrally with the body of the holder and spaced from the body member and from each other at free end portions thereof.

26. A holder as set forth in claim 25 wherein an additional flap is provided and extends at least about and forwardly of an intermediate portion of the header to restrain the latter against forward and downward pivotal movement tending to dislodge the header ears from their respective slots.

27. The combination of a bag pack and a holder for supporting the bag pack for the successive removal of individual bags therefrom; said combination comprising a bag pack including a layered stack of flexible thermoplastic bags each having flat generally co-extensive front and rear panels integrally connected along transverse bottom and opposite longitudinal side edges, a header of relatively stiff material having opposing narrow transversely extending front and rear portions respectively overlying narrow transversely extending upper edge portions of front and rear bags in the pack, said opposing header portions being interconnected at transversely spaced locations to capture and secure said upper edge portions of the bags in the pack therebetween, and each of the bags having a transversely extending tear line in at least one of its front and rear panels in spaced relationship with its transverse upper edge, and a holder including an elongated transversely extending body member adapted to be mounted adjacent and along a corner between intersecting substantially horizontal and vertical surfaces so as to releasably secure a header of a bag pack with the bags in the pack extending therefrom along one of said surfaces, said holder including means for entering between said interconnection locations and from a lower edge and between said header front and rear portions and thus securing the header and the bag pack during the successive manual tearing of individual bags therefrom.

28. The combination of a bag pack and a holder as set forth in claim 27 wherein the front and rear header portions are interconnected by means extending through the upper portion of the bag pack, and wherein the tear lines in the bags are arranged beneath said interconnection means and on a side thereof opposite the upper edges of the bags.

29. The combination of a bag pack and a holder as set forth in claim 27 wherein each bag front panel terminates short of the upper edge of its associated rear panel to provide a readily accessible opening between panels, and wherein each bag rear panel includes the aforementioned tear line at a location at least approximately coincident with the upper edge of its associated front panel.

30. The combination of a bag pack and a holder as set forth in claim 29 wherein both the rear panel tear lines and the upper edges of front bag panels are disposed beneath the interconnection between the front and rear portions of the header.

31. The combination of a bag pack and a holder as set forth in claim 29 wherein said header front and rear portions are integrally connected along upper edges thereof, and wherein said interconnection therebetween takes the form of stapling through said front and rear portions and through the upper portions of bags captured therebetween.

32. The combination of a bag pack and a holder as set forth in claim 27 wherein said holder body member is generally flat and adapted to be mounted on the horizontal surface adjacent and along the corner between the aforesaid horizontal and vertical surfaces, the bags secured by the holder depending therefrom and adjacent the vertical surface.

33. The combination of a bag pack and a holder as set forth in claim 27 wherein the front panel of each bag terminates short of the lower edge of the front portion of the header to provide a readily accessible opening between bag panels, and wherein the bag pack is secured to the holder so as to expose said front panels and openings seriatim during successive bag removal.

34. The combination of a bag pack and a holder as set forth in claim 33 wherein said holder body member is generally flat and adapted to be mounted on the horizontal surface adjacent and along the corner between the horizontal and vertical surfaces, the bags secured by the holder extending therefrom atop the horizontal surface and in a direction away from the corner between the horizontal and vertical surfaces.

35. The combination of a bag pack and a holder as set forth in claim 34 wherein the front panel of each bag terminates short of the lower edge of the front portion of the header to provide a readily accessible opening between bag panels, and wherein the bag pack is secured to the holder to expose said front panels and openings seriatim during successive bag removal.

36. The combination of a bag pack and a holder as set forth in claim 35 wherein said holder means comprises at least one flap which extends upwardly adjacent the body of the holder and enters between the front and rear header portions.

* * * * *